US008590545B2

(12) United States Patent
Won

(10) Patent No.: US 8,590,545 B2
(45) Date of Patent: Nov. 26, 2013

(54) COMPACT CASE

(75) Inventor: Soonjae Won, Hanam-si (KR)

(73) Assignee: Amorepacific Corporation, Seoul (KR)

( * ) Notice: Subject to any disclaimer, the term of this patent is extended or adjusted under 35 U.S.C. 154(b) by 0 days.

(21) Appl. No.: 12/681,446

(22) PCT Filed: Apr. 8, 2008

(86) PCT No.: PCT/KR2008/001981
§ 371 (c)(1),
(2), (4) Date: Jul. 2, 2010

(87) PCT Pub. No.: WO2009/051319
PCT Pub. Date: Apr. 23, 2009

(65) Prior Publication Data

US 2010/0288299 A1 Nov. 18, 2010

(30) Foreign Application Priority Data

Oct. 16, 2007 (KR) ..... 20-2007-0016752 U

(51) Int. Cl.

| | |
|---|---|
| ***A45D 33/24*** | (2006.01) |
| ***A45D 42/02*** | (2006.01) |
| ***B65D 43/12*** | (2006.01) |
| ***B65D 43/20*** | (2006.01) |
| ***B65D 69/00*** | (2006.01) |
| ***B65D 71/00*** | (2006.01) |

(52) U.S. Cl.
USPC ..... 132/293; 132/301; 220/345.1; 220/345.4; 206/581; 206/823; 206/235

(58) Field of Classification Search
USPC ..... 132/293, 286, 287, 291, 295, 296, 298, 132/301, 303, 315, 316, 300, 314; 206/581, 206/823, 235, 229, 38, 456, 758, 762, 772, 206/774; 220/4.22, 816, 820–824, 264, 220/281, 282, 283, 345.1, 345.4, 345.2, 220/811, 812, 813, 814, 815, 827, 828, 829, 220/831, 832; 312/9.3, 270.2, 323, 270.3, 312/334.8; 455/575.4; 248/349.1; 361/679.12
See application file for complete search history.

(56) References Cited

U.S. PATENT DOCUMENTS

| | | | | | |
|---|---|---|---|---|---|
| 1,033,526 | A | * | 7/1912 | Boye | 220/523 |
| 1,485,915 | A | * | 3/1924 | Hammel | 224/219 |
| 1,895,061 | A | * | 1/1933 | Worssam | 132/287 |
| 2,039,205 | A | * | 4/1936 | Anderl | 362/156 |
| 2,062,363 | A | * | 12/1936 | Kreisler | 132/287 |
| 2,089,834 | A | * | 8/1937 | Kasdan et al. | 132/287 |
| 2,094,006 | A | * | 9/1937 | O'Moore-Farrell | 132/318 |
| 2,099,122 | A | * | 11/1937 | Kreisler | 132/303 |

(Continued)

*Primary Examiner* — Vanitha Elgart
(74) *Attorney, Agent, or Firm* — Maxon IP, LLC.; Justin H. Kim

(57) ABSTRACT

Provided is a compact case including a cover 20, which slides parallel to the case body 10 and the fore end of the cover 20 is lifted upward by the rotating operation of the rail member 30 when the case 20 is located at the point that opening operation is completed, so that the cover 20 becomes leaned against the case body 10. According to the compact case of the present invention, user can makeup conveniently with looking at the portion to makeup in the mirror 21 attached to the cover 20, working efficiency to assemble the compact case can be improved due to the simplified structure, the cost can be reduced remarkably and stable, luxury and soft touch in use can be achieved due to the soft operation to open or close.

9 Claims, 5 Drawing Sheets

(56) References Cited

U.S. PATENT DOCUMENTS

| | | | | | |
|---|---|---|---|---|---|
| 2,415,357 | A * | 2/1947 | Kucki | 220/315 |
| 2,424,112 | A * | 7/1947 | Nehrke | 220/812 |
| 3,362,564 | A * | 1/1968 | Mueller | 220/345.3 |
| 4,526,273 | A * | 7/1985 | Tsuji et al. | 206/229 |
| 4,562,923 | A * | 1/1986 | Katada et al. | 206/235 |
| 4,697,903 | A * | 10/1987 | Koda et al. | 396/536 |
| 4,898,195 | A * | 2/1990 | Sussman | 132/317 |
| 4,932,547 | A * | 6/1990 | Rodriguez | 220/8 |
| 5,163,457 | A * | 11/1992 | Lombardi, Jr. | 132/304 |
| 5,344,037 | A * | 9/1994 | Favre | 220/264 |
| 5,353,947 | A * | 10/1994 | Zinnbauer et al. | 220/812 |
| 6,129,237 | A * | 10/2000 | Miyahara | 220/812 |
| 6,363,947 | B1 * | 4/2002 | Wu | 132/297 |
| 6,901,937 | B2 * | 6/2005 | Sebban | 132/301 |
| 6,961,977 | B2 * | 11/2005 | Seidler | 16/320 |
| 7,089,627 | B2 * | 8/2006 | Seidler | 16/320 |
| 7,513,380 | B2 * | 4/2009 | Canedo | 220/230 |
| 7,828,000 | B2 * | 11/2010 | Lee | 132/287 |
| 7,849,863 | B2 * | 12/2010 | Corbellini | 132/295 |
| 2004/0108318 | A1 * | 6/2004 | Wang | 220/345.2 |
| 2004/0129599 | A1 * | 7/2004 | Yi-Hung | 206/581 |
| 2004/0200497 | A1 * | 10/2004 | Thorpe et al. | 132/287 |
| 2006/0226164 | A1 * | 10/2006 | Graham | 220/840 |
| 2007/0261710 | A1 * | 11/2007 | Son et al. | 132/293 |
| 2008/0035643 | A1 * | 2/2008 | Hoffman et al. | 220/345.4 |
| 2008/0304215 | A1 * | 12/2008 | Chiu | 361/681 |
| 2009/0071502 | A1 * | 3/2009 | Drugeon | 132/293 |
| 2009/0071963 | A1 * | 3/2009 | Johnson et al. | 220/476 |
| 2010/0078437 | A1 * | 4/2010 | Valley, III et al. | 220/507 |

* cited by examiner

COMPACT CASE

REFERENCE TO RELATED APPLICATIONS

This application claims priority of Korean Application No. 20-2007-0016752, filed Oct. 16, 2007.

TECHNICAL FIELD

The present invention relates to a compact case whose cover is opened or closed by a sliding manner from the case body containing content, more particularly, to a compact case capable to make makeup performed conveniently by lifting the fore end of the cover to be leaned toward the case body when the sliding operation is completely performed to open so that the minor on the surface of the cover becomes leaned as much as user looks herself in the mirror well to makeup and capable to give soft touch when the cover is opened or closed considering that its main customer base is female.

BACKGROUND ART

It is general that a cosmetic case like a compact, an eyeshadow, etc. has a case body and a cover. The case body contains a content plate and a puff case while the cover is fixed to the case body by a hinge and a mirror is fixed thereto at the inner side.

This compact case is made so far only by the container having the same structure after cosmetic was developed. Although products with various shapes and designs have been made to satisfy various taste of customer in purchase, there must be a limitation in the change of the structure as long as the structure having the case body and the cover installed to the case body by the hinge is maintained, as mentioned before.

Thus, it is tried to satisfy the taste of customer by the restrictive change in the shape or color of the case rather than the improvement of the structure of the compact case having the case body and the cover installed to the case body by the hinge. However, that product has a shortage in that their life cycle is short because there is a limitation to satisfy the taste of customer through a simple change in the shape.

Also, those products has a shortage in that factors to increase customers' price of the compact case can be occurred because developing cost according the development and usage of manpower according to the research should be increased due to the short life cycle.

The applicant of the present invention has invented a compact case with complex structures of a sliding structure, a hinge structure and a fixing structure of the unfolding angle of the content case and external case as disclosed by registered utility patents Nos. 20-0393233, 20-0393234, 20-0393235 and 20-0393380; and another compact case whose cover slides to open or close from the case body as disclosed by utility patent applications Nos. 2005-29249 and 2005-30332.

The compact case disclosed by the registered utility patents Nos. 20-0393233, 20-0393234, 20-0393235 and 20-0393380 includes a cosmetic material container and a case. The cosmetic material container contains cosmetic material and guiding grooves are provided on the both sides of the cosmetic material container. A mirror is attached on the external side of the compact case, a guiding groove and a guiding protruder with a predetermined shape are provided on the both of its side walls and one of the side walls is opened so that the cosmetic material container can be appeared or disappeared by sliding.

It is not necessary to carry an extra mirror because user can look her face at any time in the mirror attached to the compact case.

Also, the user can makeup with the external mirror because the external side of the case can be leaned at a predetermined angle with respect to the cosmetic material case.

However it is necessary to make good for the compact case because its cost is high due to the complexity of the structure and there is a shortage to use both hands when pulling the content case out from the external case.

In the meantime, the compact case disclosed by the registered utility patents Nos. 2005-29249 and 2005-30332 has the structure that the cover slides along the guiding rail installed on the both sides of the case body. Although the cost of the compact case is low because its structure is very simple, there is a shortage in that the powder of the contained cosmetic material in the case body can be dropped on the cloth of the user because the cover is maintained horizontal toward the case body when it is opened or closed and the case body must be leaned when makeup with looking at the portion of the face in the mirror attached to the cover.

Thus, the applicant of the present invention invented a compact case including merits of the two type compact cases.

DISCLOSURE OF INVENTION

Technical Problem

An object of the present invention is to provide a compact case to complement the registered compact disk.

Technical Solution

The compact case according to the present invention includes a cover 20, which slides parallel to the case body 10 and the fore end of the cover 20 is lifted upward by the rotating operation of the rail member 30 when the cover 20 is located at the point that opening operation is completed, so that the cover 20 becomes leaned against the case body 10.

Advantageous Effects

According to the compact case of the present invention, the cover 20, which slides to open or close the case body 10, slides parallel to the case body 10 and the fore end of the cover 20 is lifted upward by the rotating operation of the rail member 30 when the cover 20 is located at the point that opening operation is completed, so that the cover 20 becomes leaned against the case body 10.

Further, according to the compact case of the present invention, user can makeup conveniently with looking at the portion to makeup in the minor 21 attached to the cover 20, working efficiency to assemble the compact case can be improved due to the simplified structure, the cost can be reduced remarkably and stable, luxury and soft touch in use can be achieved due to the soft operation to open or close.

BEST MODE FOR CARRYING OUT THE INVENTION

The compact case according to the present invention includes a cover 20, which slides parallel to the case body 10 and the fore end of the cover 20 is lifted upward by the rotating operation of the rail member 30 when the cover 20 is located at the point that opening operation is completed, so that the cover 20 becomes leaned against the case body 10.

MODE FOR THE INVENTION

The preferable embodiment to achieve the above object according to the present invention will be described in detail with accompanied drawings.

DESCRIPTION OF THE MEMBERS

Figure 1:
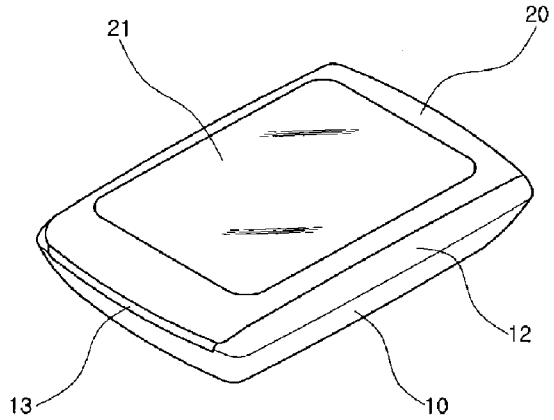
FIG. 1 shows a perspective view of the compact case according to the present invention.
Figure 2:
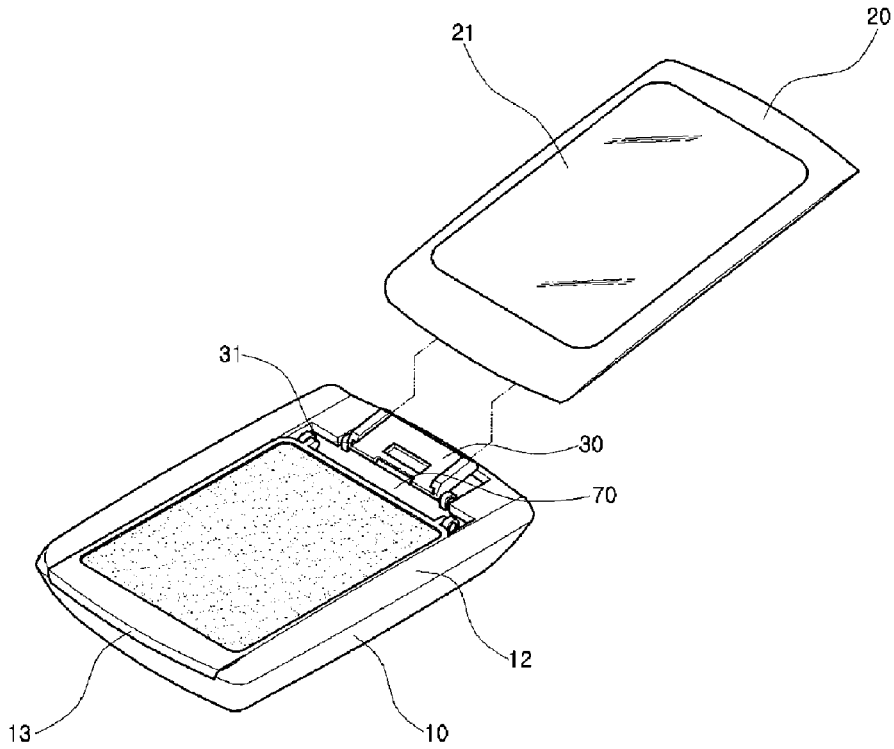
FIG. 2 shows a disassembled perspective view of the compact case according to the present invention.
Figure 3:
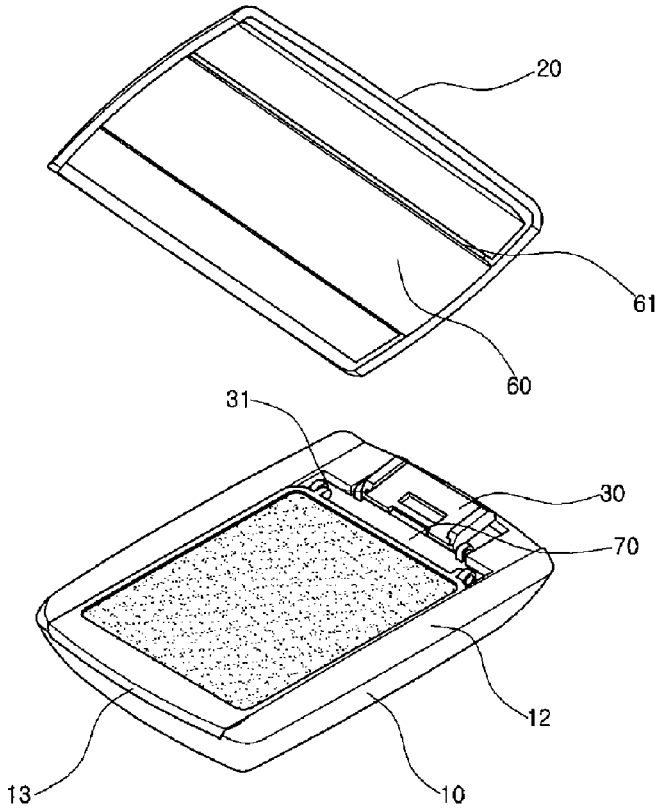
FIG. 3 shows a disassembled perspective view, showing the bottom side of the cover, of the compact case according to the present invention.
Figure 4:
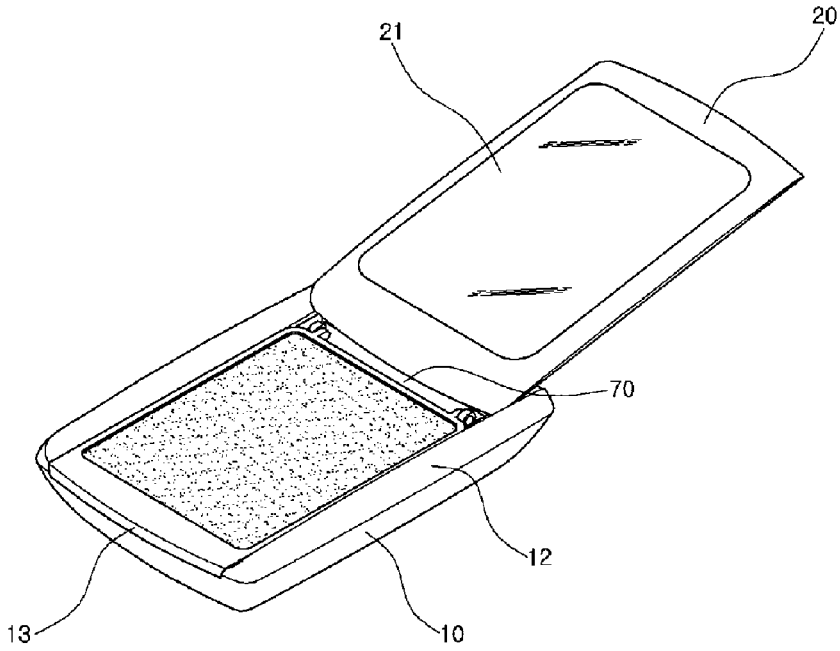
FIG. 4 shows a perspective view, showing the state that the cover becomes leaned toward the case body, of the compact case according to the present invention.
Figure 5:
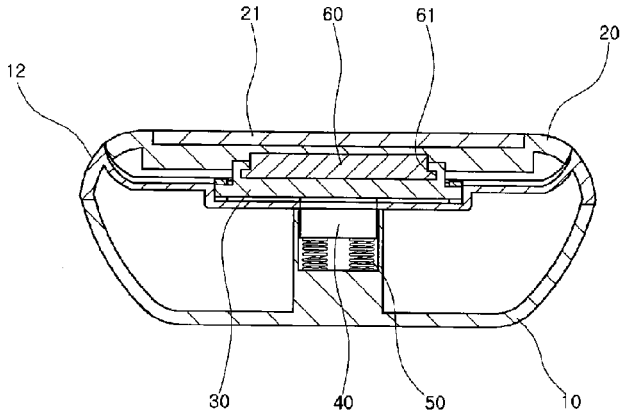
FIG. 5 shows a sectional view of the compact case according to the present invention, showing the state that the rail member of the case body and the rail plate of the cover are assembled
Figure 6:
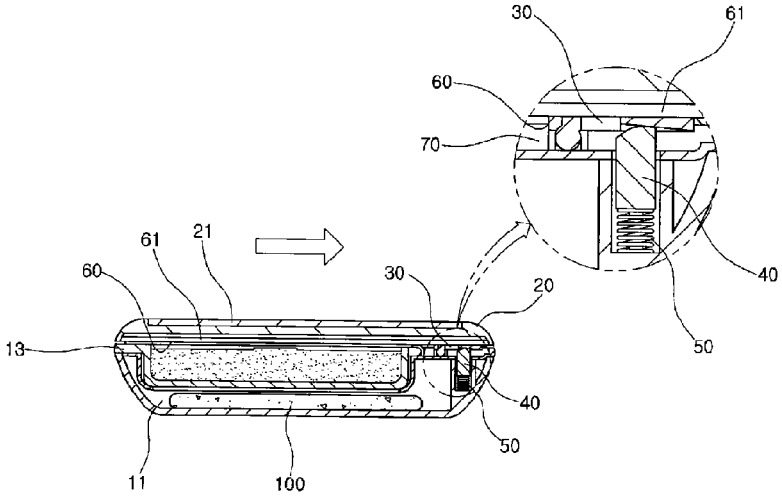
FIG. 6 shows a sectional view in the longitudinal direction of the compact case according to the present invention.

10 case body 11; depressed portion
12 rising ground 13 content plates
20; cover 21; minor
30; rail member 31; rail hole
40; pushing member 50; repulsive member
60; rail plate 61; rail
70; activity area 100; puff.

The compact case according to the present invention includes a case body 10 and a cover 20 as shown in FIG. 1 through FIG. 10.

Rising grounds 12 are formed on the both sides on the upper surface and depressed portion 11 where a content plate 13 is inserted. The content plate 13 contains a puff 100 and it is installed through a hinge at the upper surface in the longitudinal direction.

A rail member 30 is installed to rotate around the hinge on the surface next to the portion where the content plate 13 is installed. An activity area 70, where the rear end of the cover 20 becomes free, is prepared between the portion where the content plate 13 is hinged and the other portion where the rail member 30 is hinged.

Rail holes 31, through which the rail 61 of the rail plate 60 installed at the center of the bottom side of the cover 20 are inserted and guided, are prepared in the opposite directions.

The rail member 30 is installed to be lifted by the pushing member 40 installed at the case body 10 so as to receive the repulsive power of the repulsive member 50.

The repulsive member 50 to rotate the rail member 30 can be embodied in various types.

An example of the repulsive member 50 is a coil spring installed under the pushing member 40 to repulse upward or a plate spring installed on the surface of the case body 10 where an inclined plane is formed above its surface so that sliding activity against the bottom side of the rail member 30 can be done smoothly.

The spring is one of a coil spring or a plate spring.

Another example of the repulsive member 50 can be embodied by magnets with same polarity so that the rail member 30 can be rotated upward by the repulsive power of the magnets.

Such a repulsive member 50 has two magnets; a first magnet is installed at the bottom of the rail member 30 and a second magnet is installed on the surface of the rail plate 60 on the cover 20 at a position corresponding to and opposing the position of the first magnet, respectively, so that same polarities face each other.

The cover 20 slides on the surface of the case body 10. Both sides of the cover 20 are formed to be curved corresponding to the rising grounds 12 of the case body 10 and a rail plate 70 is installed at the center of the bottom.

A rail 61 through which the rail hole 31 of the rail member 30 is guided is prepared at the raised edge of the rail plate 60.

A mirror 21 is installed on the surface of the cover in order that user can makeup with viewing portion to makeup.

User pushes the cover 20 with the thumb when she wants to makeup by using cosmetic material contained in the compact case of the present invention, as described before.

Figure 7:
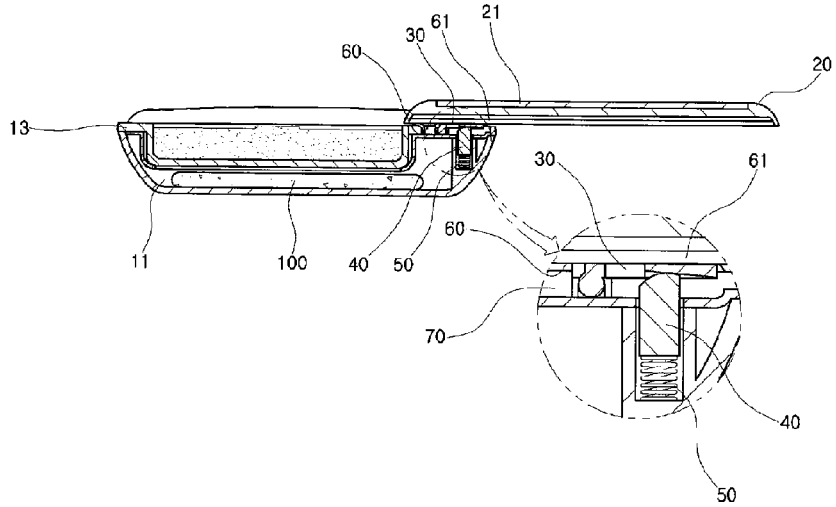
FIG. 7 shows an exemplary view of the compact case according to the present invention, showing the state that the cover is opened from the case body.
Figure 8:
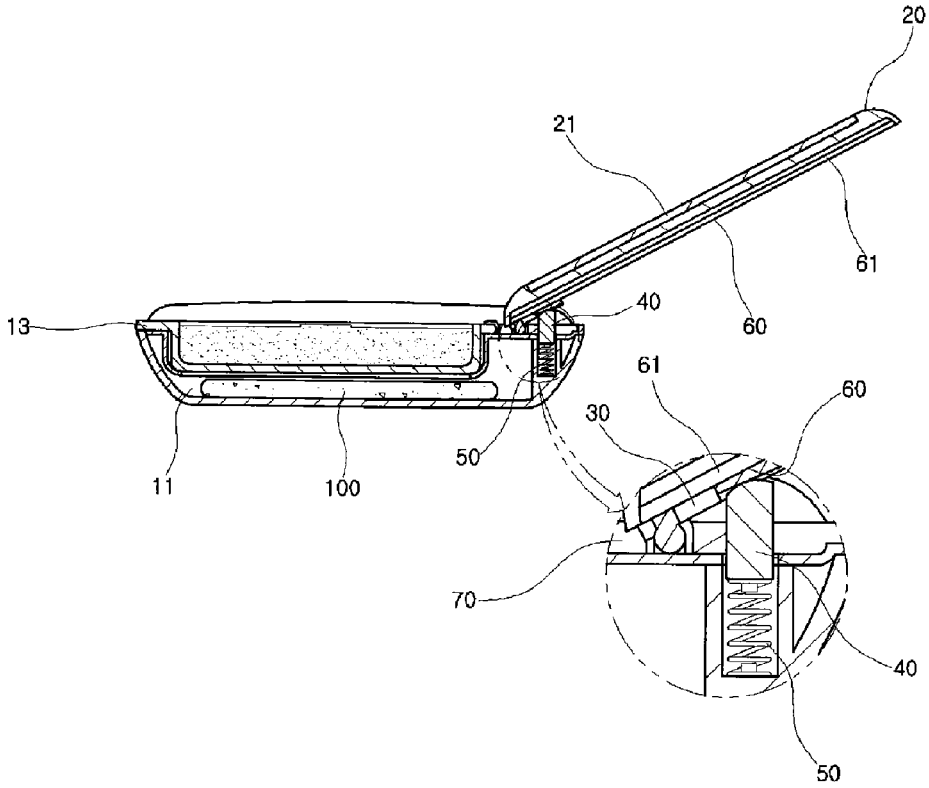
FIG. 8 shows an exemplary view of the compact case according to the present invention, showing the state that the cover is lifted by the rail member.
Figure 9:
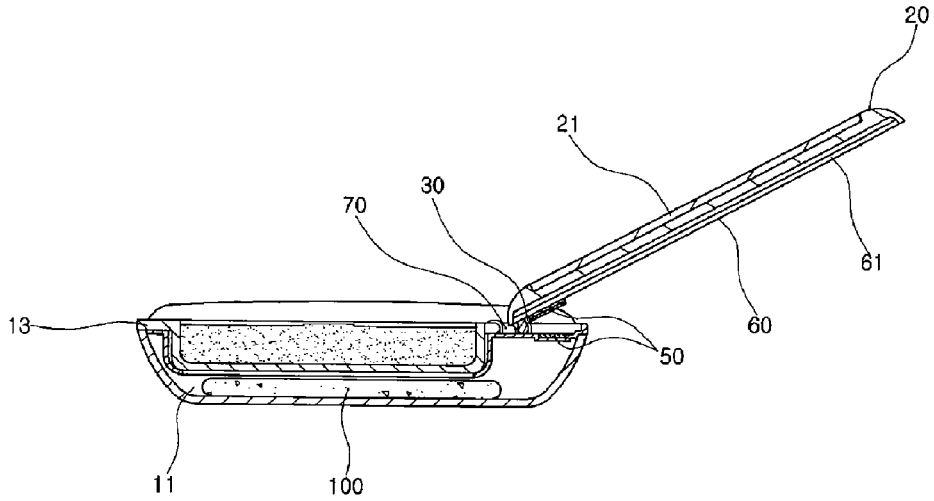
FIG. 9 shows another embodiment of the compact case according to the present invention.

As the ledge rail 61 of the rail plate 60 installed at the bottom of the cover 20 slides along the rail hole 31 of the rail member 30 installed on the surface of the case body 10, the closed cover 20 as shown in FIG. 7 is moved to open as shown in FIG. 8.

While the cover 20 is opened, the cover 20 moves parallel to the case body 10.

The reason why the cover 20 can move parallel to the case body 10 is that the cover moves in the state that the both sides of the cover 20 contact to the both of the rising grounds 12 formed on the edges of the surface of the case body 10.

When the cover 20 is opened completely, the fore end of the cover 20 lifted upward to be leaned, as shown in FIG. 8.

The operation that the fore end of the cover 20 is lifted upward to be leaned is performed by the rotation of the rail member 30 installed on the surface of the case body 10.

When the cover 20 is opened completely, the rear end of the cover 20 is located at the activity area 70 of the case body 10 and then, the cover 20 becomes free. When the cover 20 becomes free, the pushing member 40 under the rail member 30 pushes the bottom side of the cover 20 upward by the repulsive power of the repulsive member 50 so that the rail member 30 rotates around the hinge, thus the cover 20 becomes leaned toward the case body 10.

The process that the cover 20 becomes leaned toward the case body 10 will be described in detail according to each embodiment.

In the case that the repulsive member 50 is embodied by the pushing member 40, the pushing member 40 moves to rotate the rail member 30 by the repulsive power of the coin spring or the plate spring when the rear end of the cover 20 is located at the activity area 70 of the case body 10 and the cover 20 becomes free. Thus the cover 20 becomes leaned. (See FIG. 8)

Smooth rotation can be achieved because the top side of the pushing member 40 to push up and rotate the rail member 30 is curved so that the pushing member 40 can be slid well with respect to the rail member 30.

In the other case that the repulsive member 50 is embodied by magnets, the rail member 30 is rotated by the repulsive power of the magnets installed under the rail member 30 and on the surface of the case body 10 when the rear end of the cover 20 is located at the activity area 70 of the case body 10 and the cover 20 becomes free. Thus, the cover 20 becomes leaned. (See FIG. 9)

Figure 10:
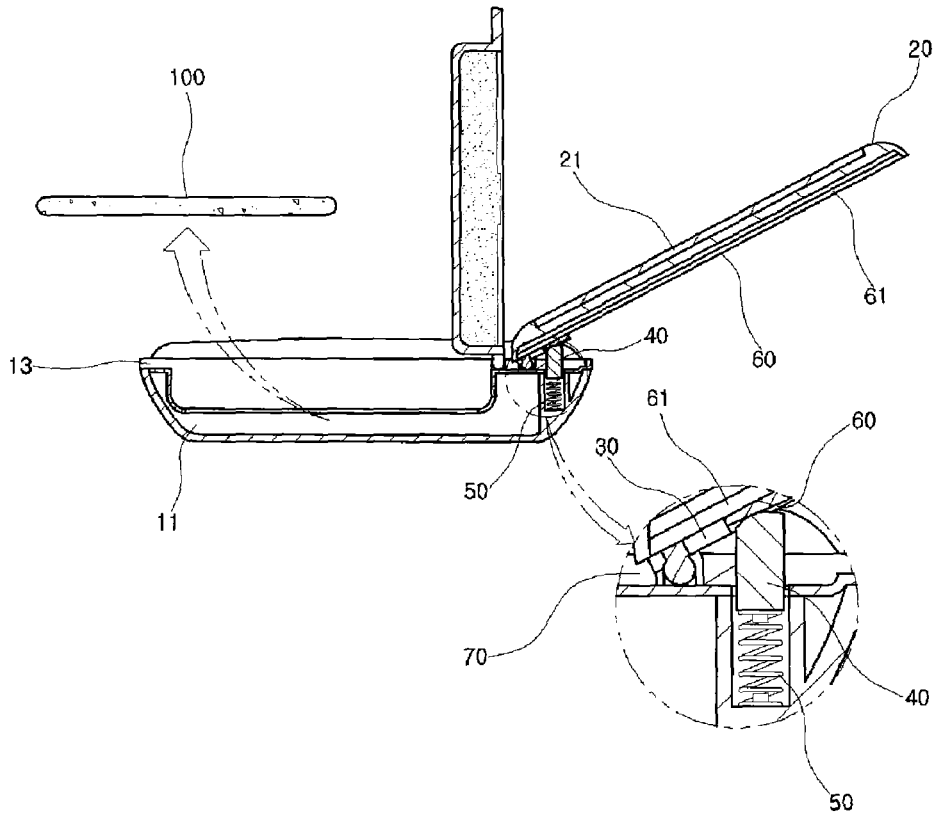
FIG. 10 shows an exemplary view of the compact case according to the present invention, showing the operation to makeup with the content of the compact case.

User can pull out the puff 100 contained in the depressed portion 11 when the cover 20 is opened from the case body 10 and the content plate 13 is lifted up, as shown in FIG. 10.

User can makeup by applying the cosmetic material contained in the content plate 13 to the puff 100.

User can makeup while she looks at the portion to makeup in the minor attached on the surface of the cover 20.

After makeup is performed, the puff 100 is inserted in the state that the content plate 13 is lifted up, the content plate 13 is located in the depressed portion 11 and then, the cover 20 is closed.

To close the cover 20, the fore end of the cover 20 is pressed slightly so that the fore end of the cover 20 moves out from the activity area 70 and then the cover 20 is slid in the reverse direction of the opening operation while the cover moves parallel to the case body secondly. By this operation, the content in the content plate 13 can be maintained safely.

INDUSTRIAL APPLICABILITY

According to the compact case of the present invention, user can makeup conveniently with looking at the portion to makeup in the minor 21 attached to the cover 20.

Further, working efficiency to assemble the compact case can be improved due to the simplified structure, the cost can be reduced remarkably and stable, luxury and soft touch in use can be achieved due to the soft operation to open or close.

The invention claimed is:

1. A compact case, comprising:

a case body;

a content plate hingedly connecting to and residing inside the case body;

a cover having a front end and a rear end slidably mounted on the case body and movable between a closed position and an open position;

a repulsive member exerting a generally upward pushing force on a pushing member, the pushing member exerting the generally upward pushing force indirectly on the cover while the cover is moving from the closed position to the open position;

a rail plate having a pair of rails, wherein the rail plate is attached to the cover;

a rail member having a pair of rail guides to allow a sliding movement of the cover; and wherein when the cover moves from the closed position to the open position, the cover slides to one side of the case body and exposes the content plate, the front end of the cover disengages from the case body while the rear end of the cover is attached to the case body, a surface of the pushing member applies the generally upward pushing force indirectly to the cover in a direction generally upward and away from the case body, thereby raising the cover to the open position with its front end defining a predetermined angle with respect to the case body and its rear end attached to the case body and wherein when the cover is tilted, its rear end is attached to the case body by engaging the rail member pivotally and directly mounted on the case body.

2. The compact case of claim 1, wherein the repulsive member is a coil spring or a plate spring.

3. The compact case of claim 1, wherein the repulsive member is normally in a state of compression.

4. The compact case of claim 1, wherein when the cover moves to the open position, the rear end pivots within an activity area proximate the repulsive member.

5. The compact case of claim 1, wherein the pushing member includes a partially-arcuate pushing surface which applies the generally upward pushing force to a rotatable rail member in contact with a back surface of the cover, the rail member being positioned to rotate upon application thereto of the generally upward pushing force, thereby moving the cover generally upward and away from the case body.

6. A compact case, comprising:

a case body;

a content plate hingedly connecting to and residing inside the case body;

a cover having a front end and a rear end slidably mounted on the case body and movable between a closed position and an open position;

a repulsive member exerting a generally upward pushing force indirectly on the cover while the cover is moving from the closed position to the open position;

a rail plate having a pair of rails, wherein the rail plate is attached to the cover;

a rail member having a pair of rail guides to allow a sliding movement of the cover; and wherein when the cover moves from the closed position to the open position, the cover slides to one side of the case body and exposes the content plate, the front end of the cover disengages from the case body while the rear end of the cover is attached to the case body, the repulsive member applies the generally upward pushing force indirectly to the cover in a direction generally upward and away from the case body, thereby raising the cover to the open position with its front end defining a predetermined angle with respect to the case body and its rear end attached to the case body and wherein when the cover is tilted, its rear end is attached to the case body by engaging the rail member pivotally and directly mounted on the case body.

7. The compact case of claim 6, wherein the repulsive member comprises a first magnet provided on a bottom side of the rail member and a second magnet provided on the rail plate at a position corresponding to and opposing the first magnet, wherein the two magnets have identical polarities so that one exerts a repulsive force on the other.

8. The compact case of claim 6, wherein the repulsive member is normally in a state of compression.

9. The compact case of claim 6, wherein when the cover moves to the open position, the rear end pivots within an activity area proximate the repulsive member.

* * * * *